US009493902B2

(12) United States Patent
Del Pos et al.

(10) Patent No.: US 9,493,902 B2
(45) **Date of Patent: *Nov. 15, 2016**

(54) HOUSEHOLD APPLIANCE FOR WALL MOUNTING

(75) Inventors: Maurizio Del Pos, Pordenone (IT); Daniele Favaro, Pramaggiore (IT)

(73) Assignee: Electrolux Home Products Corporation N.V., Brussels (BE)

( * ) Notice: Subject to any disclaimer, the term of this patent is extended or adjusted under 35 U.S.C. 154(b) by 1189 days.

This patent is subject to a terminal disclaimer.

(21) Appl. No.: 13/504,341

(22) PCT Filed: Oct. 22, 2010

(86) PCT No.: PCT/EP2010/065949

§ 371 (c)(1),
(2), (4) Date: Jun. 6, 2012

(87) PCT Pub. No.: WO2011/051176

PCT Pub. Date: May 5, 2011

(65) Prior Publication Data

US 2012/0242205 A1 Sep. 27, 2012

(30) Foreign Application Priority Data

Oct. 29, 2009 (EP) ..... 09174424

(51) Int. Cl.
*D06F 39/12* (2006.01)

(52) U.S. Cl.
CPC ..... *D06F 39/125* (2013.01)

(58) Field of Classification Search
CPC .... D06F 39/12; D06F 37/267; D06F 39/125; D06F 37/22; D06F 39/083
USPC ..... 68/140, 139, 24, 212, 16, 142; 34/91, 34/139, 601, 603, 602, 106, 108, 239; 312/228, 245
See application file for complete search history.

(56) References Cited

U.S. PATENT DOCUMENTS

| | | | |
|---|---|---|---|
| 2,986,915 | A | 6/1961 | Nau |
| 3,064,361 | A | 11/1962 | Turner |
| 3,383,776 | A | 5/1968 | Wilhoyte |

(Continued)

FOREIGN PATENT DOCUMENTS

| | | |
|---|---|---|
| EP | 1995370 A1 | 11/2008 |
| GB | 1412837 | 11/1975 |

(Continued)

OTHER PUBLICATIONS

Nov. 19, 2014—(US) Non-Final Office Action—U.S. Appl. No. 13/504,340.

(Continued)

*Primary Examiner* — David Cormier
*Assistant Examiner* — Thomas Bucci
(74) *Attorney, Agent, or Firm* — Banner & Witcoff, Ltd.

(57) ABSTRACT

A household appliance (100) has an external casing (110) housing a rotatable drum assembly (320) and adapted to be mounted to a wall (105). At least one support bracket (505;1105;1305) is intended to engage a corresponding counter-bracket (530;1005) attached to the wall so that the household appliance can be hung-up on the wall. The at least one support bracket is associated with a hub (705,710,730; 705,710,730,1210,1205;705,710,730,1305) for rotatably supporting the rotatable drum assembly.

20 Claims, 10 Drawing Sheets

(56) References Cited

U.S. PATENT DOCUMENTS

| | | | | |
|---|---|---|---|---|
| 3,471,940 | A * | 10/1969 | Smith | 34/603 |
| 4,868,998 | A | 9/1989 | Rubin | |
| D314,070 | S | 1/1991 | Rubin | |
| 5,388,344 | A * | 2/1995 | Wallach | 34/91 |
| 5,421,175 | A * | 6/1995 | Niu | 68/17 R |
| 5,443,538 | A | 8/1995 | Little | |
| 5,568,691 | A | 10/1996 | Rubin | |
| 5,946,814 | A | 9/1999 | Farrant | |
| 6,195,910 | B1 | 3/2001 | Robineau | |
| 7,213,349 | B1 | 5/2007 | Brunner | |
| 2007/0074543 | A1* | 4/2007 | Lim et al. | 68/140 |
| 2012/0233873 | A1* | 9/2012 | Del Pos et al. | 34/108 |
| 2012/0233876 | A1 | 9/2012 | Weldon et al. | |
| 2012/0242205 | A1 | 9/2012 | Del Pos et al. | |

FOREIGN PATENT DOCUMENTS

| | | | |
|---|---|---|---|
| GB | 2 459 344 | 10/2009 | |
| GB | 2459344 A * | 10/2009 | D06F 58/02 |
| JP | 2001-182970 | 7/2001 | |
| JP | 2007-120835 | 5/2007 | |
| JP | 2009-030909 | 2/2009 | |

OTHER PUBLICATIONS

Jul. 10, 2014—(US) Final Office Action—U.S. Appl. No. 13/504,340.

Mar. 20, 2014—(US) Non-Final Office Action—U.S. Appl. No. 13/504,340.

International Search Report issued in corresponding International Application No. PCT/EP2010/065949, mailed Feb. 12, 2010.

European Search Report issued in corresponding European Application No. 09174424.3, dated Apr. 21, 2010.

International Search Report issued in related International Application No. PCT/EP2010/065975, mailed Feb. 10, 2011.

European Search Report issued in related European Application No. 09174419.3, dated Mar. 25, 2010.

European Office Action issued in related European Application No. 09174419.3, dated Nov. 29, 2011.

* cited by examiner

HOUSEHOLD APPLIANCE FOR WALL MOUNTING

BACKGROUND OF THE INVENTION

Field of the Invention

The present invention generally relates to the field of household appliances, and in particular to laundry washing and washing/drying appliances like laundry washers and washers/dryers. Specifically, the present invention relates to a household appliance designed for wall mounting.

Overview of the Related Art

Household appliances designed for wall mounting are known in the art. This kind of installation is useful in those situations where space is so limited that there is no room for accommodating a floor-standing appliance, or for appliances of small size, designed with a reduced load capacity (e.g., 1.5-2 kg of cotton load), for example targeted to people living as singles, or for installation in hotel rooms, or aboard ships.

For example, U.S. Pat. No. 4,868,998 discloses a wall-mounted tumble dryer. Other examples of wall-mounted garment dryer are provided in U.S. Pat. No. 5,568,691.

Conventionally, the household appliance is mounted to the wall by means of brackets, attached to the rear side of the appliance external cabinet, and that engage counter-brackets attached to the wall by means of screws.

SUMMARY OF SELECTED ASPECTS OF THE INVENTION

The Applicant has observed that, in general, a problem encountered in mounting to a wall household appliances having a rotating drum for loading items to be treated, like laundry washers and washers/dryers, is the vibrations that inevitably are generated when the drum rotates, for washing or drying the items under treatment; the problem is especially felt in laundry washers and washers/dryers, because in the spinning phase of the washing cycle the rotational speed of the drum needs to be relatively high for efficiently removing water from the wet items. Such vibrations, that in floor-standing appliances are transmitted to the cabinet and then to the floor, in a wall-mounted appliance are instead transmitted to the wall, producing undesired noise, and, in time, they may even compromise the fixation of the appliance to the wall, and damage the wall structure. In order to keep vibrations low, the load capacity of the appliance or/and the rotational speed of the drum should be kept low.

In view of the state of the art outlined above, the Applicant tackled the problem of devising a household appliance intended for wall mounting, which is of simple construction, is easy to assemble, has a reduced cost, and which, at the same time, has a wall-mounting arrangement adapted to reduce the vibrations and to ensure a homogeneous transfer of forces to the wall.

According to an aspect of the present invention, there is provided a household appliance comprising an external casing that houses a rotatable drum assembly and which is adapted to be mounted to a wall. The appliance comprises at least one support bracket intended to engage a corresponding counter-bracket attached to the wall, so that the household appliance can be hung-up on the wall, said at least one support bracket being associated with a hub provided for rotatably supporting the rotatable drum assembly.

The hub may in particular be that part that contains roller bearings or similar means for rotatably supporting the drum driving shaft; the hub may be part of, or be connected to, a tub accommodating the rotatable drum, like the washing tub of a laundry washer or washer/dryer.

The hub may thus comprise a seat for accommodating the bearings for rotatably supporting the driving shaft for driving in rotation the drum assembly.

The hub may in particular comprise a sleeve accommodating the bearings.

The household appliance may comprise a tub accommodating the drum assembly. The tub may have a back wall with a portion formed by injection moulding directly over said sleeve.

Alternatively, the back wall of the tub may comprise a portion defining said sleeve and formed by injection moulding directly over said bearings.

The at least one bracket may be either rigidly connected or elastically coupled to the rotatable drum assembly hub.

In particular, the at least one bracket may be fixed, at one end thereof, to said sleeve.

In an embodiment of the invention, the at least one bracket may be fixed, at one end thereof, to a damping material collar inserted onto said sleeve.

The at least one bracket may comprise a plurality of relatively narrow brackets arranged in circumferential succession.

At least one of the plurality of brackets may extend substantially vertically from the axis of the drum, and at least another one of the plurality of brackets may extend substantially horizontally from the drum axis.

In alternative embodiment of the invention, the at least one bracket has an angular extension of approximately 180°.

The at least one bracket may be coupled to the hub by means of springs and dampers.

The at least one bracket may in particular be coupled, through said springs and dampers, to the sleeve accommodating the bearings.

Said shaft may be driven by a motor either by direct drive or through a belt transmission.

The household appliance may be one among a laundry washer and a laundry washer/dryer.

BRIEF DESCRIPTION OF THE DRAWINGS

These and other features and advantages of the present invention will be made clear by the following detailed description of some embodiments thereof, provided merely by way of non-limitative examples. The description should be read in conjunction with the attached drawings, wherein.

DETAILED DESCRIPTION OF EXEMPLARY EMBODIMENTS OF THE INVENTION

Hereinafter, several embodiments according to the present invention of a household appliance designed for wall mounting, will be presented and described. Even if in the following description the assumption is made that the household appliance is a laundry washer, the invention applies straightforwardly to other types of appliances, like laundry washer/dryers, and in general the advantages of the present invention are achievable in any household appliance having a rotating drum for accommodating the items to be treated, particularly where the drum rotation speed may be relatively high.

Figure 1:
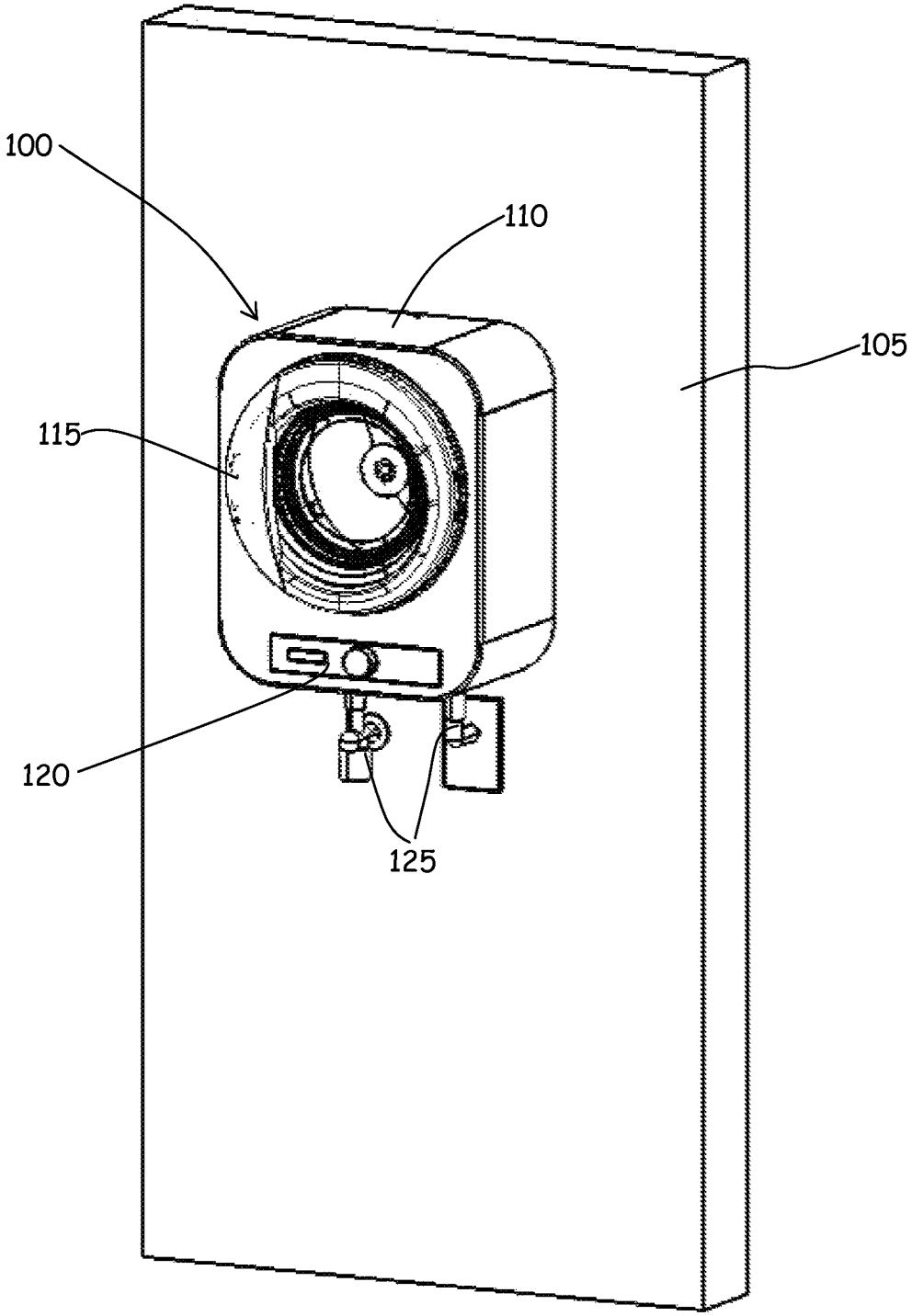
FIG. 1 shows a household appliance mounted to a wall according to the present invention.

Referring to the drawings, in FIG. 1 there is shown a laundry washer 100 according to the present invention, mounted to a wall 105. The laundry washer 100 comprises an external casing 110, accommodating therein a washing tub and, inside the tub, a rotating drum. The casing 110 has a front opening, for allowing access to the drum and load/unload of the items to be treated, and a door 115 is provided for closing the load/unload opening. Below the door 115, a control and indicator panel (user interface) 120 is provided. Also shown in the drawing are connectors 125, provided on the wall 105, to which a fresh water intake (cold or/and hot) and a discharge outlet of the laundry washer 100 are connected, respectively for the intake of fresh water and for the discharge of the washing liquid.

Figure 2:
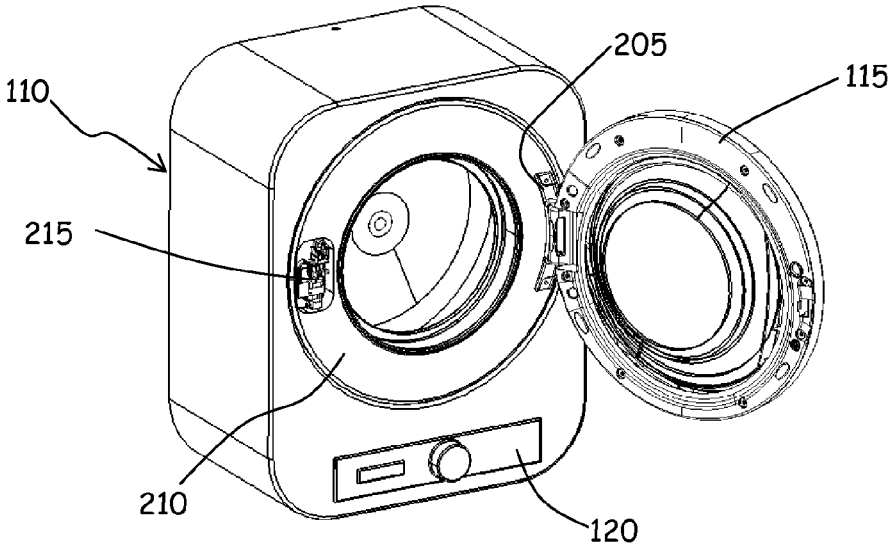
FIG. 2 shows an embodiment according to the present invention of the household appliance of FIG. 1 detached from the wall and with the door open.
Figure 3:
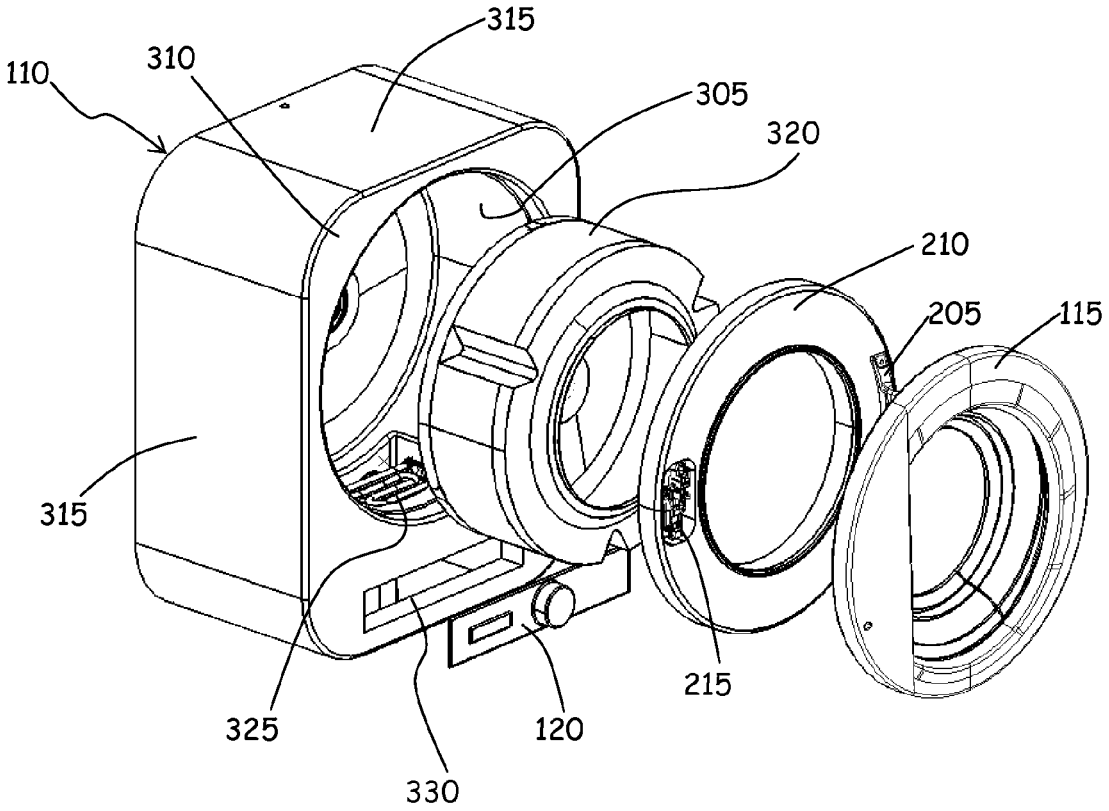
FIG. 3 shows the household appliance of FIG. 2 in exploded view.
Figure 4:
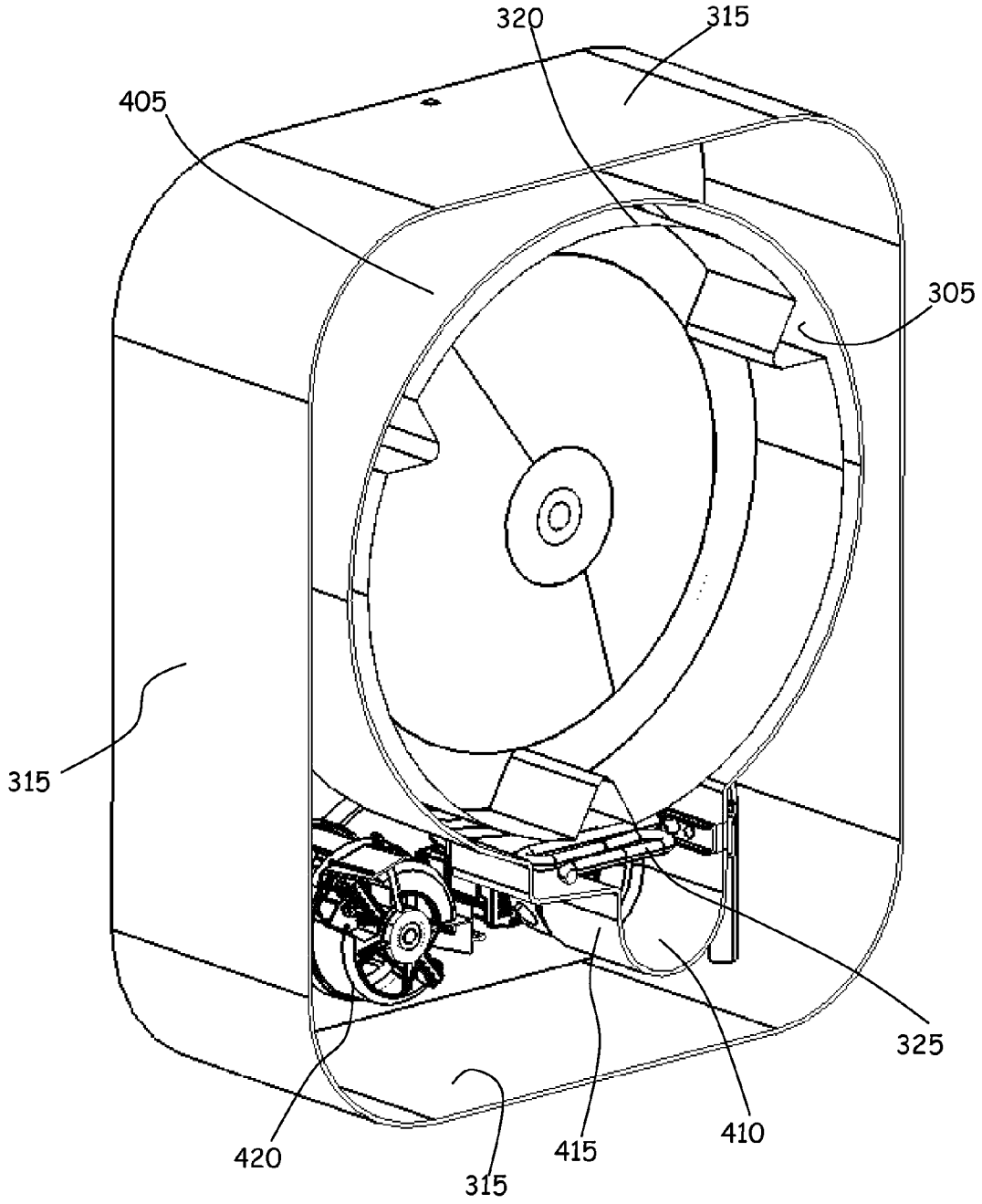
FIG. 4 shows the household appliance of FIGS. 2 and 3 from the rear, sectioned along a vertical plane transverse to the drum rotation axis.

FIGS. 2 to 4 show different views of the laundry washer 100, according to an embodiment of the present invention.

The external casing 110, generally rectangular in shape, is constituted by a plastic body, formed for example by injection moulding, open at the rear, and the tub, denoted 305 in FIG. 3, is integrated in, integrally formed with the casing 110, being in one piece therewith. In other words, the casing 110 is shaped so as to define thereinside the tub 305; in particular, as better visible in FIG. 4, the tub 305 is a substantially cylindrical hollow space delimited laterally by a generically cylindrical wall 405 rearwardly projecting from, a front wall 310 of the casing 110, and, rearwardly, by a back wall 500 better visible in FIG. 5, the cylindrical wall 405 and the back wall 500 being in one piece with the casing 110. The casing 110 has four perimetral walls 315 that extend rearwardly from respective corners of the front wall 310.

The choice of the plastic material to be used for forming the casing 110 may depend on aesthetic requirements. In fact, thanks to the wall-mounting arrangements according to the various embodiments of the present invention, the cabinet 110 has no structural function.

The dimensions of the casing 110 are such as to be able to accommodate, in addition to the drum 320 of desired size and capacity (e.g., 1.5-2 Kg of cotton load), all the necessary components of the laundry washer. For example, a heater 325 for heating the washing liquid, which, as visible in FIG. 4, is mounted at the bottom of the tub 305, just above a sump 410 defined by a downwardly projecting portion 415 of the cylindrical wall 405 that defines the tub 305. Other components include for example a motor for rotating the drum and, possibly, the means for the motion transmission from the motor to the drum, the hydraulic circuit for the circulation of the washing liquid, and a liquid discharge pump or valve. In case the appliance is a washer/dryer, additional or different components are accommodated within the casing 110, like a drying air circulation system, including a demoisturizing system for example comprising an air-cooled condenser, a water-cooled condenser, a condenser part of a heat pump system, a defluff filter and any other known component necessary for a dryer.

The door 115 may be hinged at 205 to a circular front flange 210 that is mounted frontally (for example by means of screws and/or glue and/or welding) to the front wall 310 of the cabinet 110, along the rim of the load/unload opening. The flange 210, in addition to being provided with the hinge for the door 115, also incorporates a safety door lock mechanism 215, and also has sealing purposes.

The control panel 120 is accommodated in a recess 330 formed in the front wall 310 of the cabinet, below the load/unload opening.

In FIGS. 5 to 9, a wall-mounting arrangement according to an embodiment of the present invention for mounting to the wall 105 the laundry washer 100 is shown. In this embodiment, for mounting the laundry washer 100 to the wall 105, three angularly spaced apart, relatively narrow brackets 505 are provided, at the rear of the appliance. The brackets 505, which can be in any suitable material, for example sheet metal, are, at the two ends thereof, bent to form appendages 505*a* and 505*b* approximately orthogonal to a main bracket arm 505*c*, the latter extending radially from the hub of the rotatable drum.

In particular, one of the brackets 505 extends approximately vertically, whereas the remaining two extend approximately horizontally in opposite directions. It is however pointed out that the number of brackets 505 and their orientation do not constitute a limitation for the present invention.

Figure 6A:
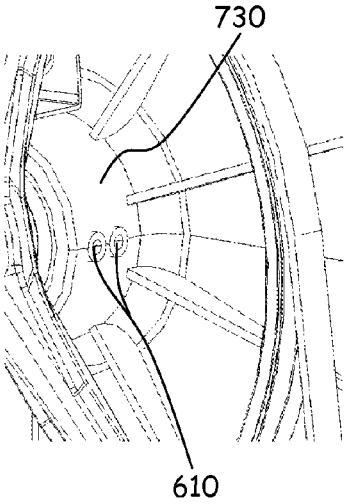
FIGS. 6A and 6B show two details of the wall-mounting arrangement shown in FIG. 5.
Figure 6B:
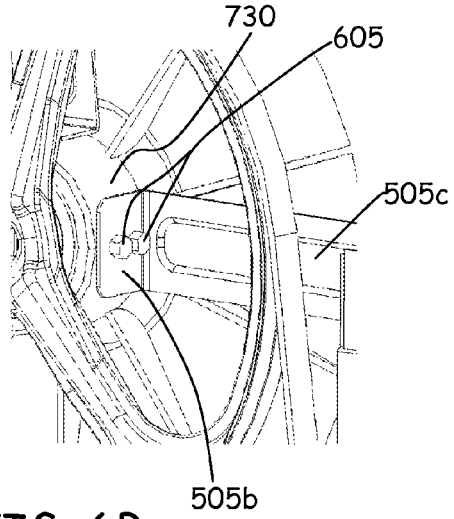
Figure 7:
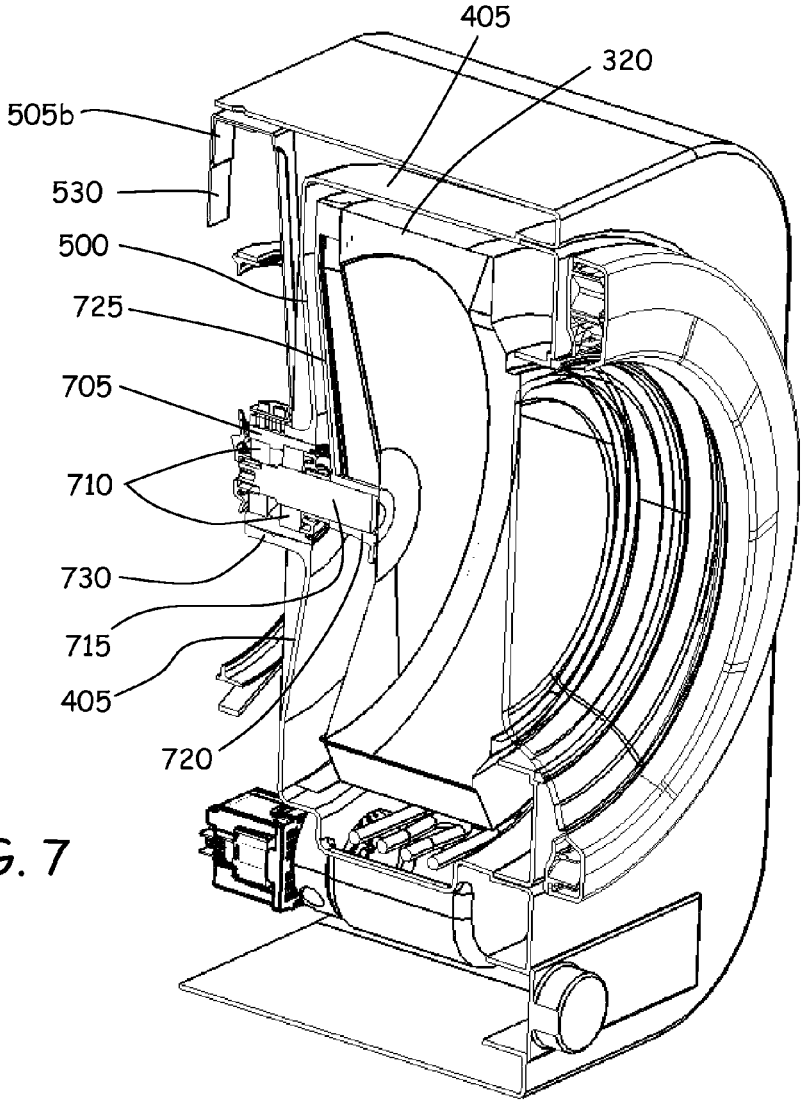
FIG. 7 shows the household appliance of FIG. 5 sectioned along a vertical plane containing the drum rotation axis.

The three brackets 505 are attached at their radially inner end 505*a* to the hub that rotatably supports the rotatable drum, as visible in detail in FIGS. 6A, 6B and 7. In particular, in correspondence of their appendage 505*a*, the brackets 505 are fixed to a hub sleeve 705 accommodating therein one or more roller bearings 710 for rotatably supporting a shaft 715 that drives the drum 320 to rotate. The shaft 715 is, in the example here considered, connected to a driven pulley 510 that is driven to rotate by an electric motor 420 through a belt transmission 520. The other end of the shaft 715 is inserted into a collar 720 of a (typically three-arm) spider 725 that is conventionally fixed to the rear wall of the drum 320.

The brackets 505 are each fixed to the sleeve 705 by means, for example, of (a pair of) screws 605. The sleeve 705 that accommodates the roller bearings 710 may be coated by a plastic sleeve or collar 730 that is part of, in one piece with the back wall 500 of the washing tub 305, and that is formed by injection moulding directly over the sleeve 705 containing the bearings 510 (in other words, for the production of the cabinet 110 the sleeve with the roller bearings already inserted is put into the mould used to form the cabinet). The sleeve 705 may be formed so to have, in three angularly spaced apart positions, (one or two) radial protrusions with threaded holes 610 for receiving the screws 605, the openings of the holes 610 remaining accessible after the plastic collar 730 is formed by injection of plastic over the sleeve 705.

The sleeve 705 may be in metal, e.g. in aluminium, or in plastic, and, in this latter case, it may in turn be formed by injection moulding directly over the bearings 710. In alternative embodiments of the invention, the function of the sleeve 705 may be performed by the plastic collar 730, the collar 730 being in this case formed by injection moulding directly over the bearings 710 (in this case, the roller bearings 730 are put in the mould used to form the cabinet 110).

Figure 8:
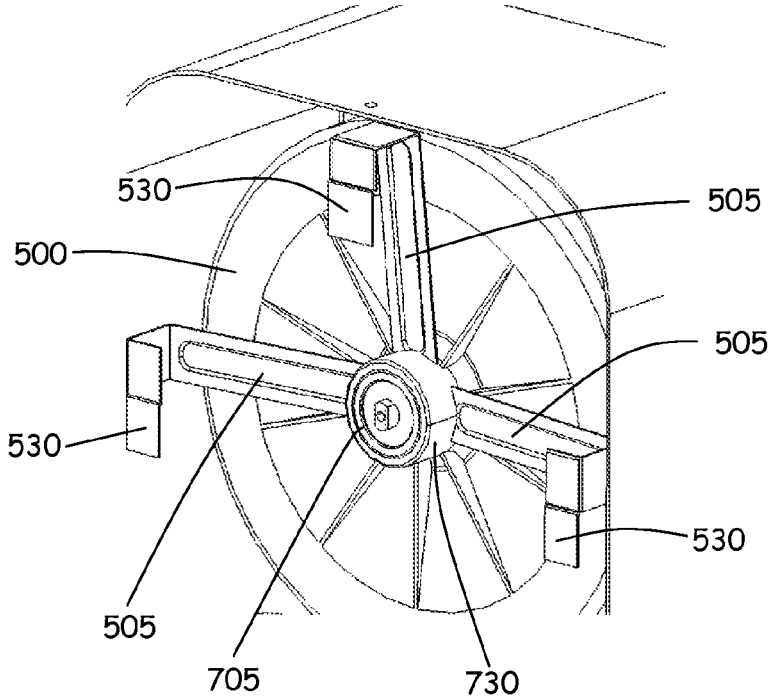
FIG. 8 shows a detail of an alternative construction to what is shown in FIGS. 6A and 6B.

In alternative embodiments of the invention, the brackets 505 may be in one piece with the sleeve 705 (and thus the brackets are of the same material as the sleeve 705), as shown in FIG. 8. Another possible alternative is to form the brackets 705 in one piece with the plastic collar 730, i.e. as an integral part of the cabinet 110.

At their other, radially external appendage 505*b*, the brackets 505 are bent so as to have a generically "U" shape, adapted to cooperate with respective counter-brackets 530 attached to the wall 105, for example by means of screws (not shown). The counter-bracket 530 that is associated with the bracket 505 extending vertically has an inverted "L" shape, so as to provide an upper abutment surface for the appendage 505*b* of the vertical bracket 505.

Figure 5:
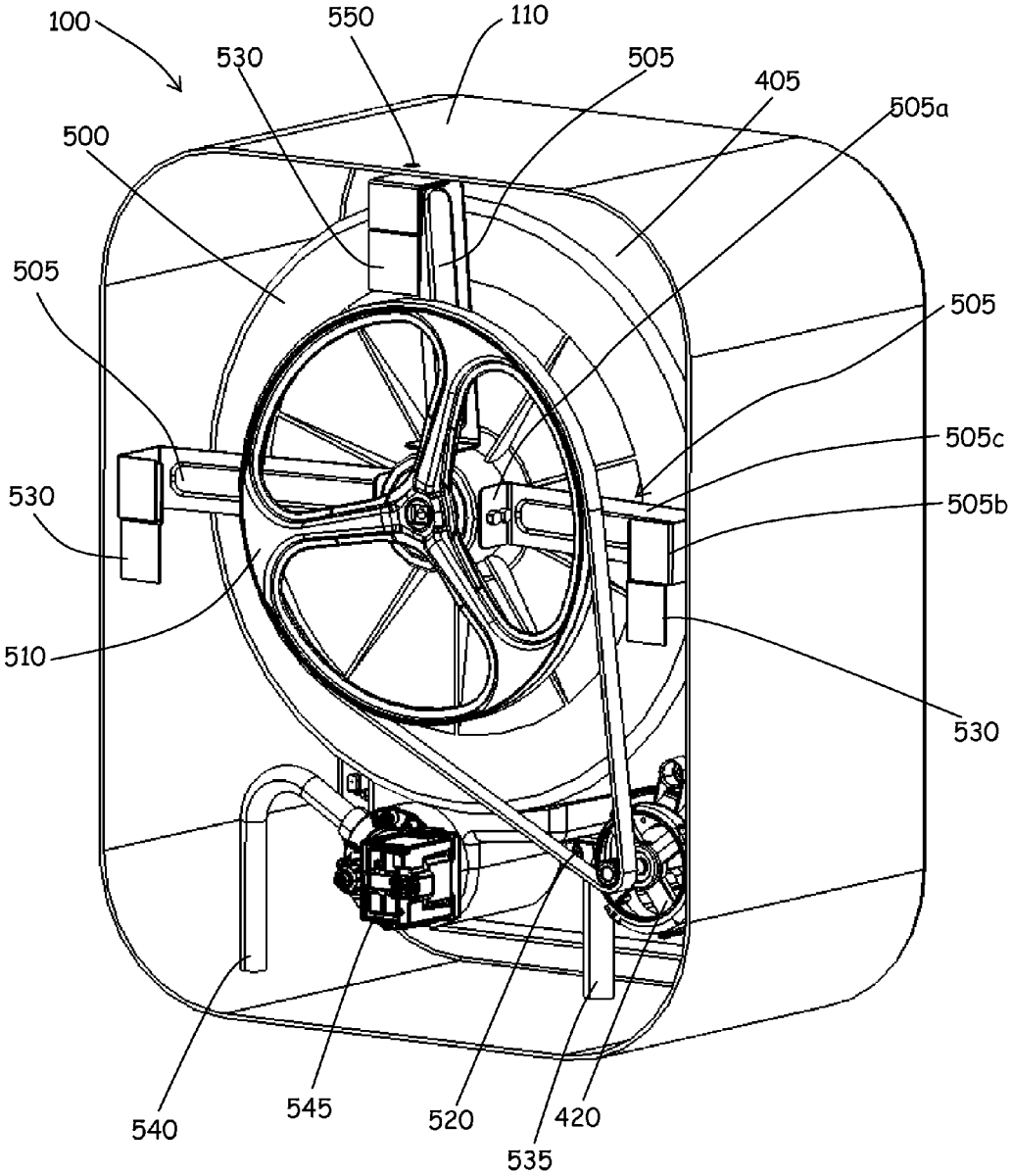
FIG. 5 is a view from the rear of the household appliance of FIGS. 2 to 4 showing a wall-mounting arrangement according to an embodiment of the present invention.

In FIG. 5 there are also shown flexible pipes 535 and 540, respectively for the connection, for example by means of quick couplings, to the connectors 125 on the wall 105, respectively for intaking fresh water and for discharging the washing liquid. Also visible is a discharge pump 545 which is mounted at the rear of the sump 410 and to the outlet of which the pipe 540 is connected. The pipe 540 preferably forms an inverted siphon, so as to ensure that, within the tub 305, a prescribed amount of water/washing liquid remains when the laundry washer is in operation.

In this way, the laundry washer 100 may be mounted to the wall 105 by directly hanging it up to the counter-brackets 530, in such a way that the "U"-shaped ends 505*b* of the brackets 505 engage each a respective counter-bracket 530. The laundry washer 100 may be mounted to the wall 105 already fully assembled, or with the casing 110 removed (for facilitating the subsequent operations of hydraulic connections of the appliance to the connectors 125).

Once hung up to the counter-brackets 530, the cabinet 110 may be secured at 550, by a screw, to the upper counter-bracket 530.

The laundry washer 100 is simple in construction, has a reduced number of parts (in particular, due to the fact that the cabinet and the washing tub are in a single piece), is easy to assemble and thus can be produced at reduced costs. In addition, thanks to the fact that the laundry washer 100 is hung-up to the wall through the brackets 505 that are fixed to the hub that rotatably supports the rotatable drum 320, particularly to the hub sleeve 705 accommodating the roller bearings 710 for rotatably supporting the drum drive shaft 715, the forces originating during the drum rotation are homogeneously transmitted to the wall: it is as if the drum is rotatably supported directly by the wall. Neither the appliance cabinet 110 nor the walls of the tub 305 have to sustain any force originating from the wall mounting, so the cabinet and particularly the tub can be formed relatively light and thin in structure, and in a plastic material not particularly resistant to mechanical stresses, thus of relatively low cost.

Figure 9:
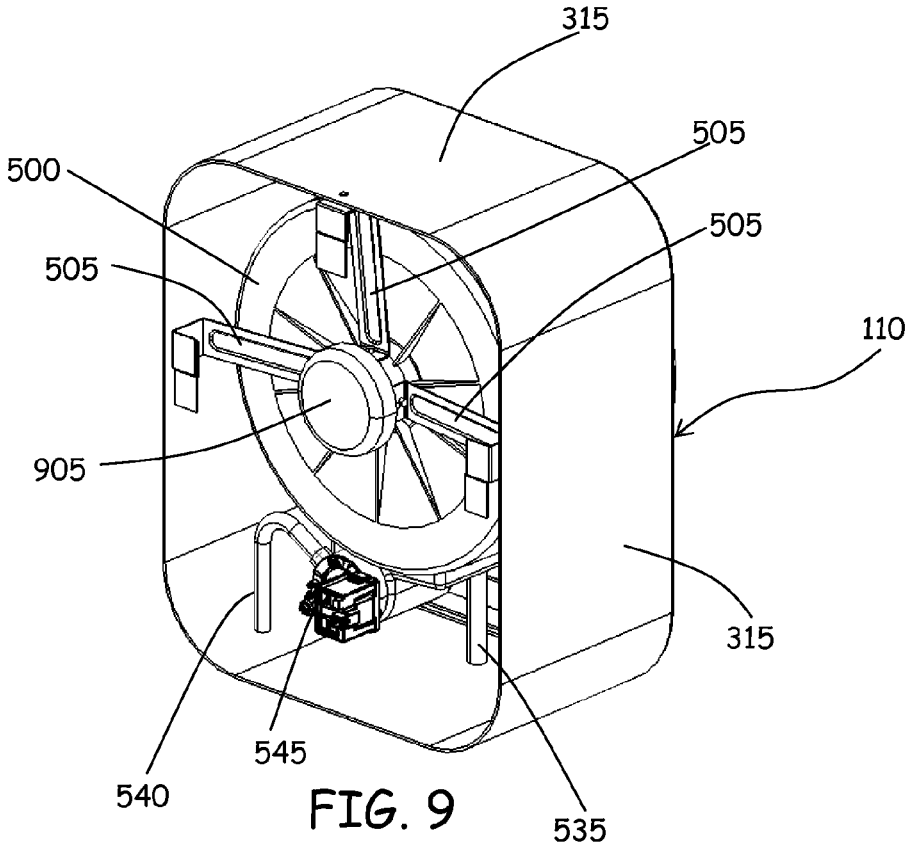
FIG. 9 shows an alternative drum driving arrangement according to an embodiment of the present invention.

In alternative embodiments of the invention, a direct drive of the shaft 515 may be envisaged, instead of the belt transmission 220, as shown in FIG. 9. The direct drive has the advantage that the structure is more balanced, thanks to the fact that the electric motor 905 is coaxial to the drum rotation axis.

Figure 10:
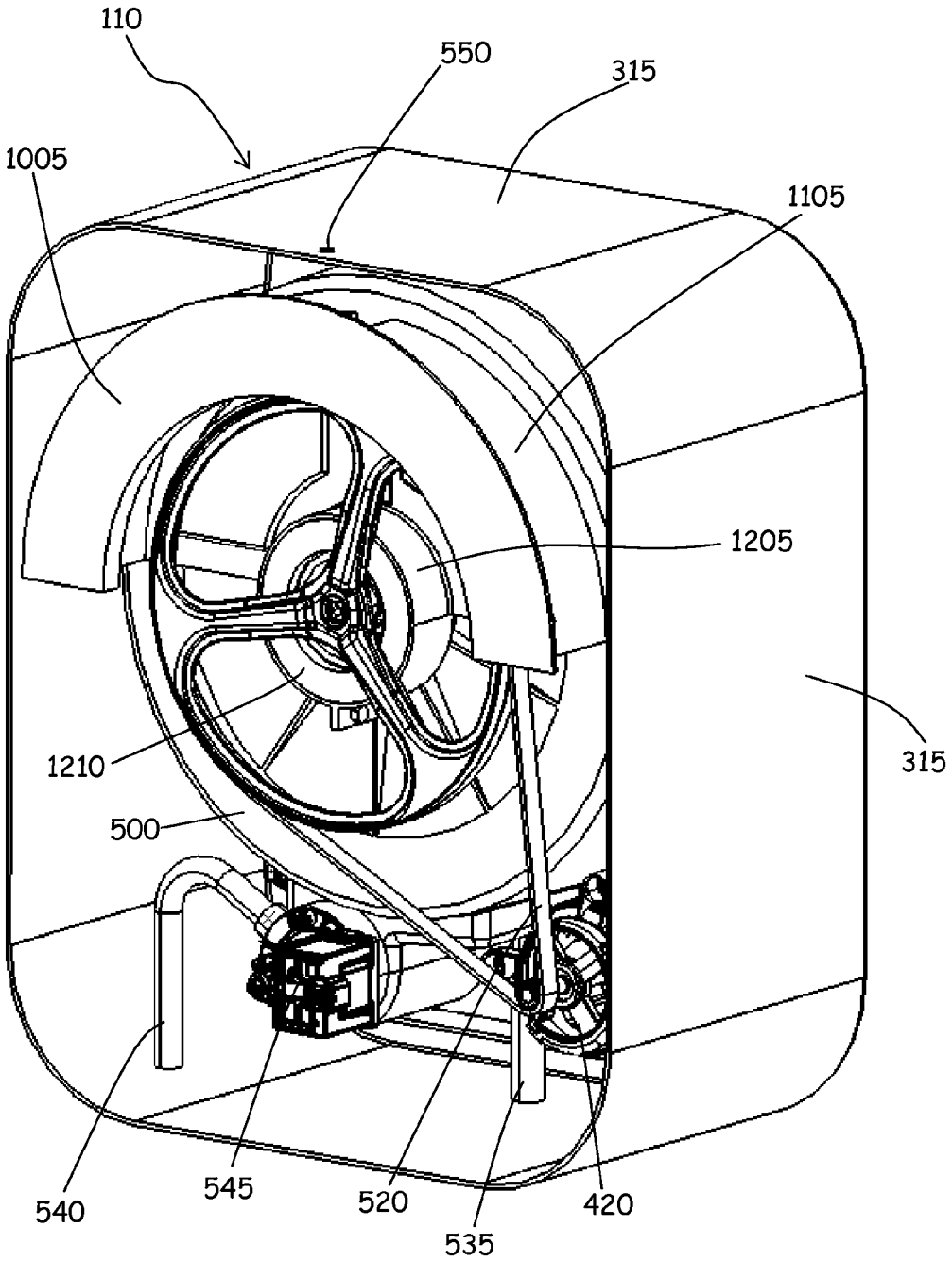
FIG. 10 shows, in a view similar to that of FIG. 5, another wall-mounting arrangement according to an embodiment of the present invention.
Figure 11:
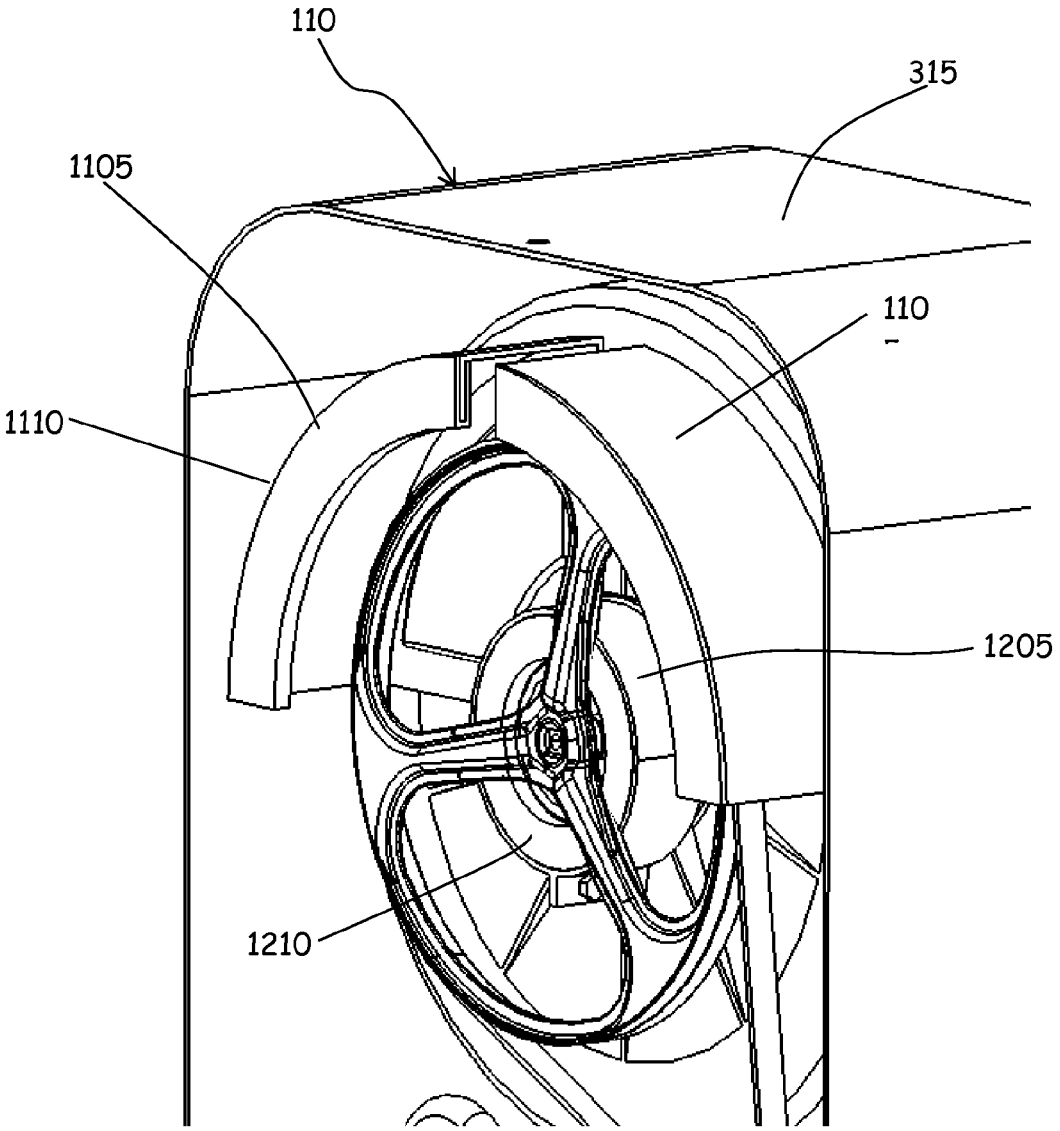
FIG. 11 shows a detail of wall-mounting brackets of the wall-mounting arrangement of FIG. 10.
Figure 12:
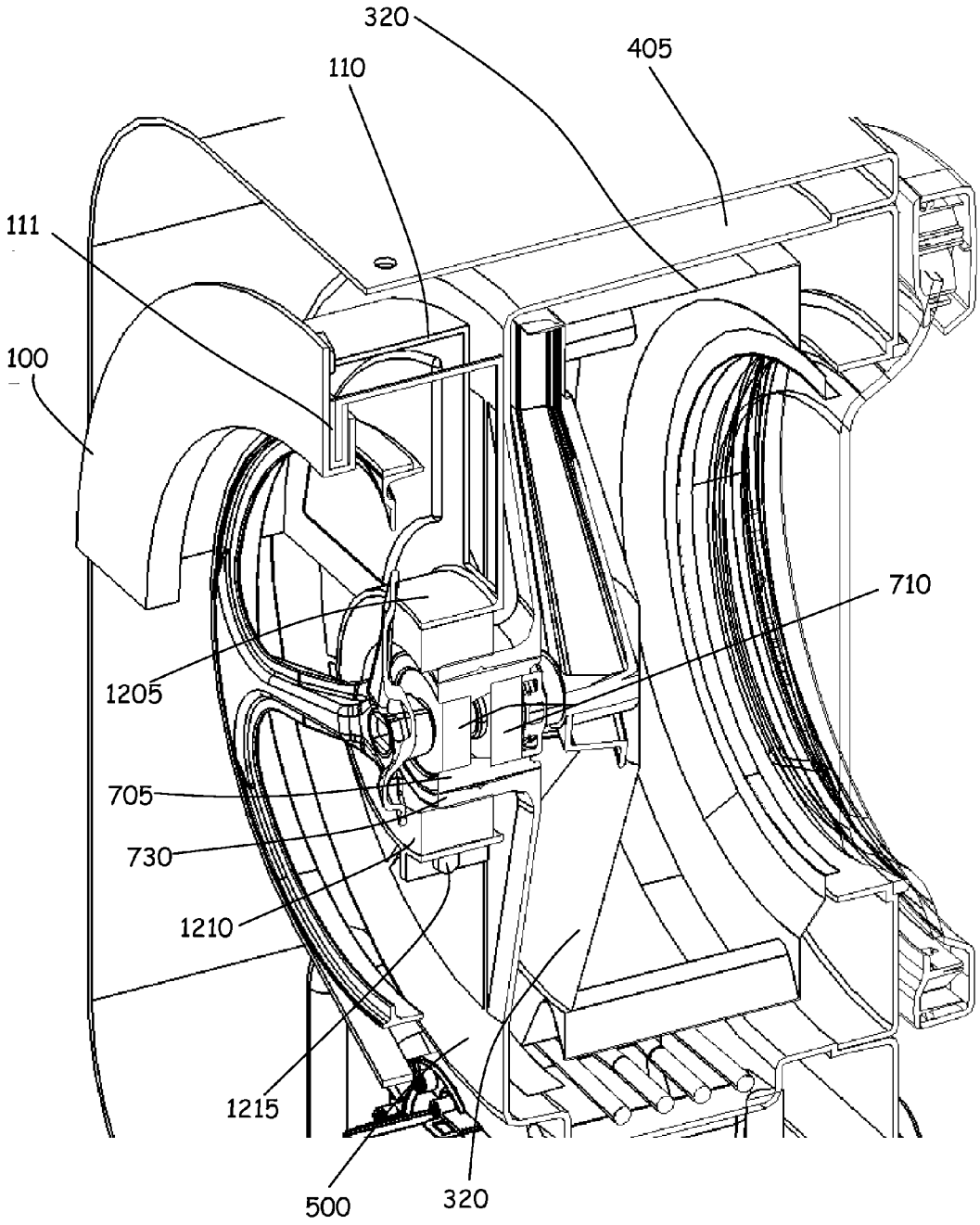
FIG. 12 shows the household appliance of FIGS. 10 and 11, sectioned along a vertical plane containing the drum rotation axis.

Another embodiment of the present invention is shown in FIGS. 10 to 12. This embodiment differs from the previously described one in that the three relatively narrow brackets 505 are replaced by one or two brackets 1105 having wide angular extension; for example, the two brackets 1105 may overall extend for 180°. The radially outer end of the two brackets 1105, bent in a similar way as the radially outer ends 505*b* of the brackets 505, so as to have a generically "U" shape, engages a counter-bracket 1005, having angular extension corresponding to that of the two brackets 1105, and that is attached to the wall 105, for example by means of screws (not shown).

As visible in FIG. 12, the brackets 1105 extend radially from a central collar 1205, which is preferably inserted over a vibration-damping material sleeve 1210 over the plastic collar 730 or inserted directly over the plastic collar 730; the brackets and the collar 1205 may be formed in metal or in plastic material. The collar 1205 may for example be secured to the vibration-damping material sleeve 1210 by means of one or more screws (not shown), and/or the collar 1205 may have a longitudinal cut so to be tightenable, by means e.g. of a screw-and-nut 1215, on the vibration-damping material sleeve 1210.

Optionally (or in alternative to the provision of the vibration-damping material sleeve 1210), between the ends of the brackets 1105 and the counter-bracket 1005, a band of a vibration damping material 1110 is interposed.

Compared to the previously described wall-mounting arrangement, this arrangement allows a better distribution and transmission of the forces to the wall.

Figure 13:
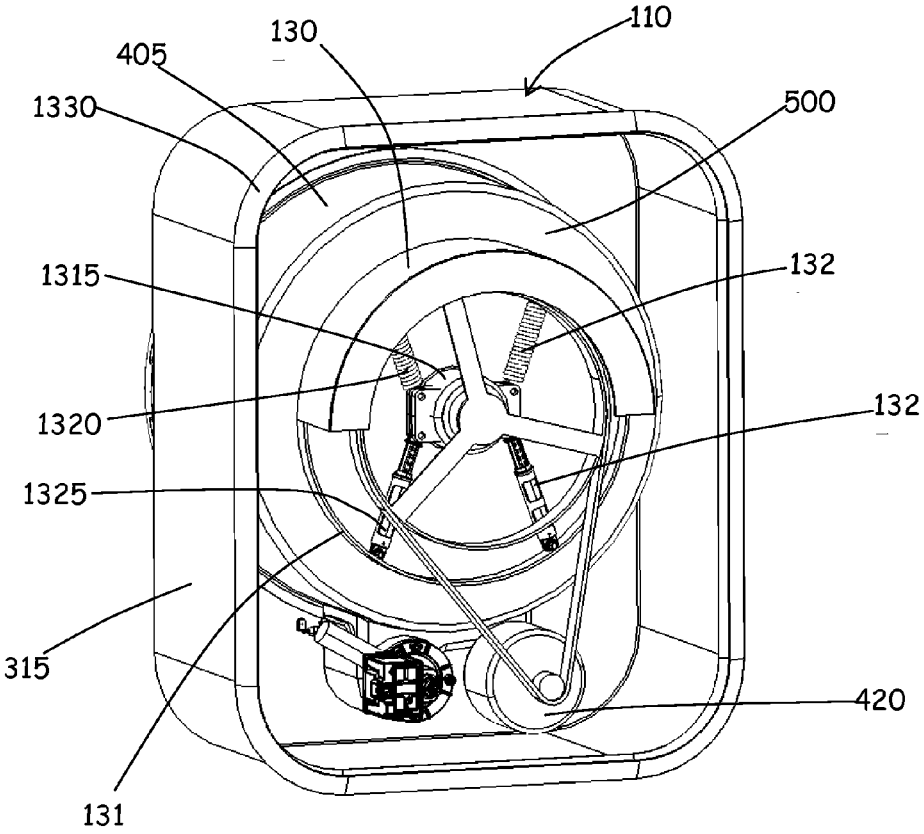
FIG. 13 shows, in a view similar to that of FIG. 5, a wall-mounting arrangement according to still another embodiment of the present invention.
Figure 14:
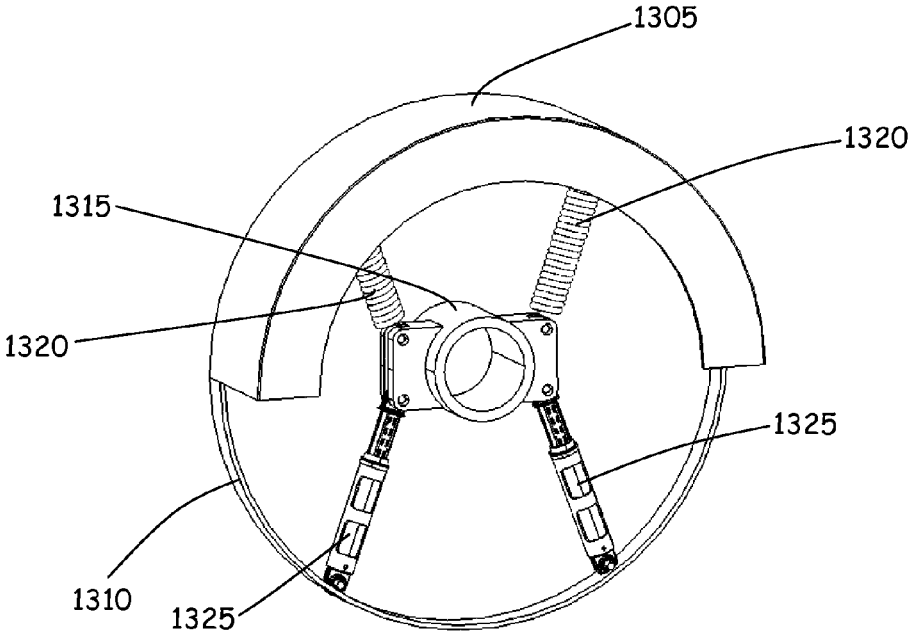
FIG. 14 shows a detail of a wall-mounting mounting bracket of the household appliance of FIG. 13.

Yet another embodiment of the present invention is shown in FIGS. 13 and 14. In this embodiment, the laundry washer 100 is mounted to the wall 105 by means of a bracket 1305, of relatively wide angular extension, for example approximately 180° as in the previous embodiment, which in operation engages a counter-bracket (not shown), similar to the counter-bracket 1005 as in the previous embodiment. The bracket 1305 has a narrower portion 1310 that extends 360°. A central sleeve 1315 is elastically coupled to the bracket 1305 by means of two springs 1320 and two hydraulic or pneumatic dampers 1325. The sleeve 1315 is part of the hub that rotatably supports the rotatable drum 320, and for example the sleeve 1315 is inserted on the plastic collar 730, or the sleeve 1305 may perform the function of the sleeve 705 of the previously described embodiment.

Along the rear rim of the cabinet 110, a rubber frame 1330 is preferably provided, which, when the laundry washer 100 is hung up to the wall-mounted counter-bracket, adheres to the wall 105 surface, and acts as a vibration absorber.

Optionally, an elastic connection, e.g. a spring (not shown) between the sleeve 1305 and the wall 105 may be provided for, in order to maintain the cabinet 101 adherent to the wall 105 even when the drum is loaded.

Several embodiments of the present invention has been here described, however it will be clear to those skilled in the art that other embodiments are possible, all falling within the scope of the invention as defined in the appended claims.

The invention claimed is:

1. A household appliance comprising:

an external casing housing a rotatable drum assembly and adapted to be mounted to a wall; and a plurality of support brackets, each configured to engage a corresponding counter-bracket attached to the wall so that the household appliance can be hung-up on the wall, wherein each support bracket is coupled to a hub for rotatably supporting the rotatable drum assembly, and wherein the plurality of support brackets extend radially from the hub and are configured to engage the corresponding counter-brackets at three points arranged circumferentially around the hub through an arc of approximately 180°.

2. The household appliance of claim 1, wherein the hub comprises a seat for accommodating bearings for rotatably supporting a driving shaft for driving in rotation the drum assembly.

3. The household appliance of claim 2, wherein the hub comprises a sleeve accommodating the bearings.

4. The household appliance of claim 3, comprising a tub accommodating the drum assembly, the tub having a back wall with an injection moulded portion moulded directly over the sleeve.

5. The household appliance of claim 3, comprising a tub accommodating the drum assembly, the tub having a back wall, the back wall having an injection moulded portion defining the sleeve and moulded directly over the bearings.

6. The household appliance of claim 1, wherein the plurality of support brackets are either rigidly connected or elastically coupled to the rotatable drum assembly hub.

7. The household appliance of claim 3, wherein the plurality of support brackets are either rigidly connected or elastically coupled to the rotatable drum assembly hub and at least one bracket is fixed, at one end thereof, to the sleeve.

8. The household appliance of claim 3, wherein the plurality of support brackets are either rigidly connected or elastically coupled to the rotatable drum assembly hub and at least one bracket is fixed, at one end thereof, to a damping material collar inserted onto the sleeve.

9. The household appliance of claim 1, wherein the plurality of support brackets comprise a plurality of relatively narrow brackets arranged in circumferential succession.

10. The household appliance of claim 9, wherein at least one of the plurality of brackets extends substantially vertically from an axis of the drum, and at least another one of the plurality of brackets extends substantially horizontally from the drum axis.

11. The household appliance of claim 2, wherein the shaft is driven by a motor either by direct drive or through a belt transmission.

12. The household appliance of claim 1, wherein the household appliance is one among a laundry washer and a laundry washer/dryer.

13. A household appliance comprising:

an external casing housing a rotatable drum assembly and adapted to be mounted to a wall; and a support bracket configured to engage a corresponding counter-bracket attached to the wall so that the household appliance can be hung-up on the wall, wherein the support bracket is coupled to a hub for rotatably supporting the rotatable drum assembly, and wherein the support bracket forms an angular extension arranged circumferentially around the hub through an arc of approximately 180°.

14. The household appliance of claim 13, wherein the hub comprises a seat for accommodating bearings for rotatably supporting a driving shaft for driving in rotation the drum assembly and a sleeve accommodating the bearings.

15. The household appliance of claim 14, comprising a tub accommodating the drum assembly, the tub having a back wall with an injection moulded portion moulded directly over the sleeve.

16. The household appliance of claim 14, comprising a tub accommodating the drum assembly, the tub having a back wall, the back wall having an injection moulded portion defining the sleeve and moulded directly over the bearings.

17. The household appliance of claim 13, wherein the support bracket is coupled to the hub by means of springs and dampers.

18. The household appliance of claim 14, wherein the support bracket is coupled, by means of springs and dampers, to the sleeve.

19. The household appliance of claim 15, wherein the support bracket is coupled, by means of springs and dampers, to the sleeve.

20. The household appliance of claim 16, wherein the support bracket is coupled, by means of springs and dampers, to the sleeve.

* * * * *